United States Patent [19]

Mason

[11] 4,165,130

[45] Aug. 21, 1979

[54] IMPACT TUNNELING MACHINE WITH CUTTERS SPACED FOR EQUAL WORK

[76] Inventor: Warren S. Mason, R.R. 2, Box 179H, Chicago Heights, Ill. 60411

[21] Appl. No.: 867,024

[22] Filed: Jan. 5, 1978

[51] Int. Cl.[2] ..... E21D 9/10

[52] U.S. Cl. ..... 299/62; 299/18; 299/56

[58] Field of Search ..... 299/62

[56] References Cited

U.S. PATENT DOCUMENTS

| | | | |
|---|---|---|---|
| 900,951 | 10/1908 | Proctor | 299/62 |
| 3,005,627 | 10/1961 | Tinlin | 299/62 X |
| 3,314,724 | 4/1967 | Tinlin | 299/62 |
| 4,013,319 | 3/1977 | Wise | 299/62 X |
| 4,052,107 | 10/1977 | Hay | 299/62 |

*Primary Examiner*—Ernest R. Purser

*Attorney, Agent, or Firm*—Richard G. Kinney

[57] ABSTRACT

A tunneling machine provided with the plurality of impact type cutting tools adapted to be mounted on a rotatable or oscillatable workhead assembly in such order and number that the work done by each of said tools upon angular movement of the workhead is generally equal. The working heads of the tools are mounted in close fit through a circulator disc shaped shield which prevents rock or like particles from passing beyond the workhead area to the bodies of the impact tools. Movement is imparted to the workhead assembly by a plurality of self propelled mechanisms which, along with the workhead, are concentrically surrounded by an enclosed tubular shroud which extends generally the length of the machine and is affixed to the shield. A plurality of suction tubes or conduits, arranged on the interior of the shroud, and also passing through the shield in close fit, are adapted for communicable association with the workhead area and an elongate suction tube which also serves as a supportive structure for the machine whereby the cuttings are removed from workhead area through the conduits to the tube as they are formed.

8 Claims, 10 Drawing Figures

FIG. 1
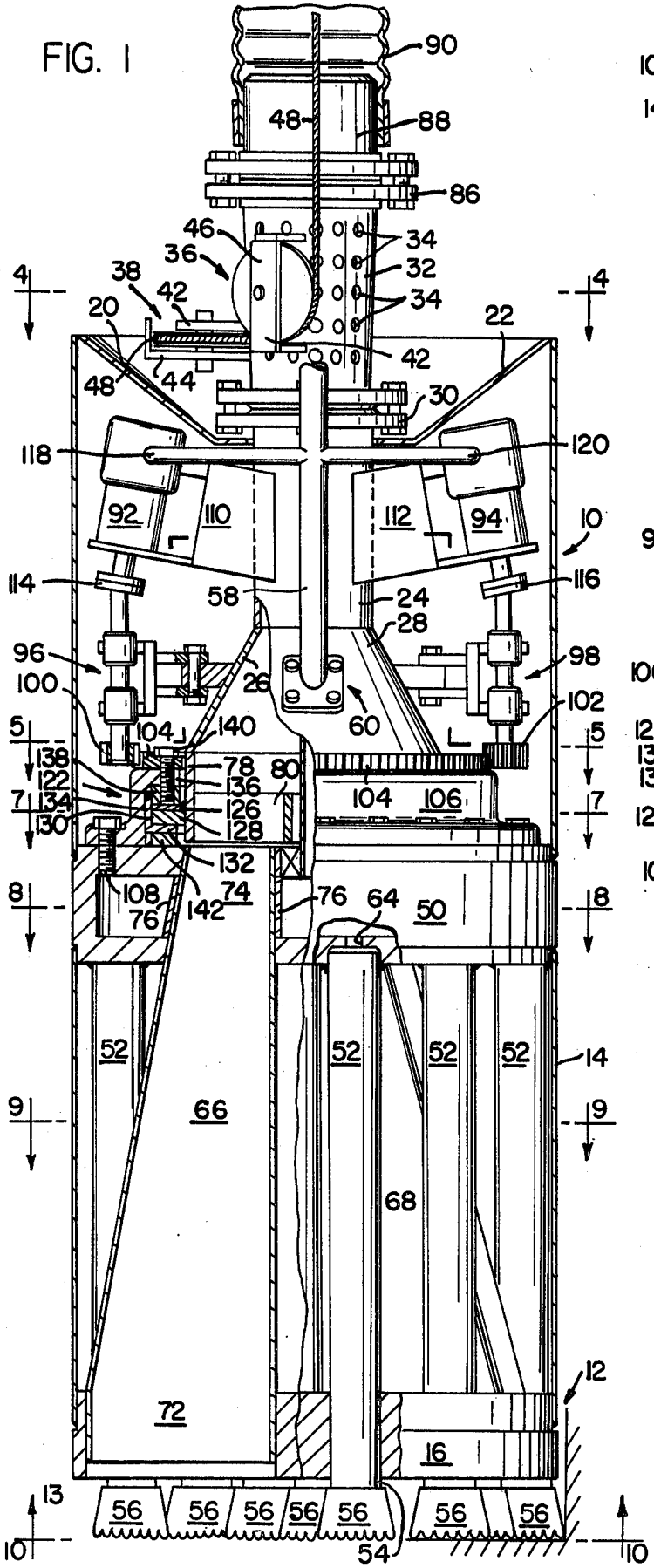
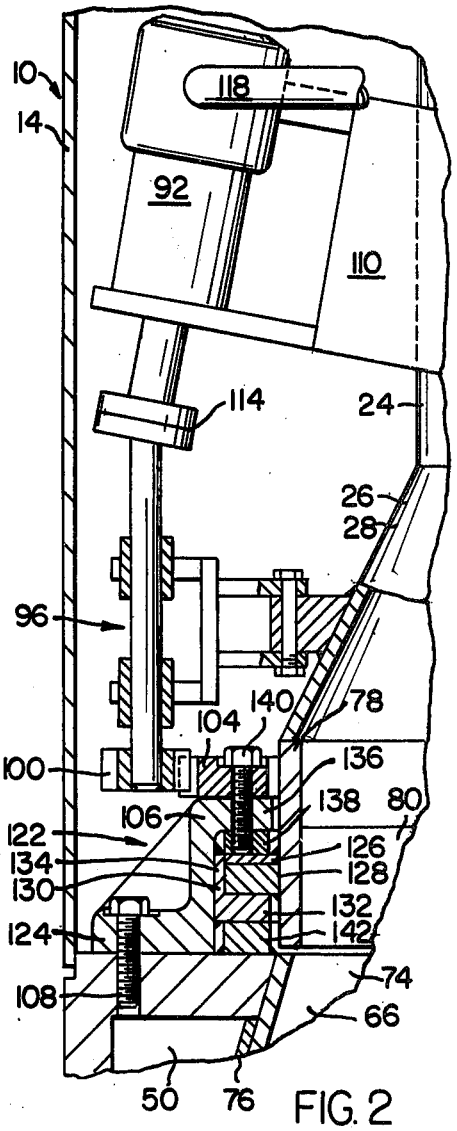
FIG. 2
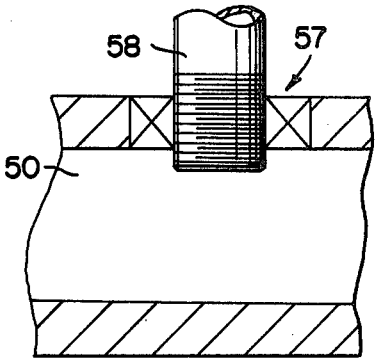
FIG. 3

FIG. 4
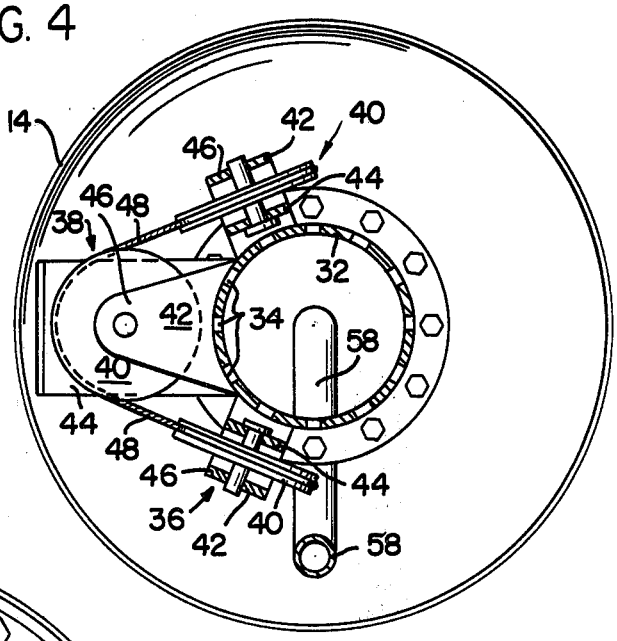
FIG. 5
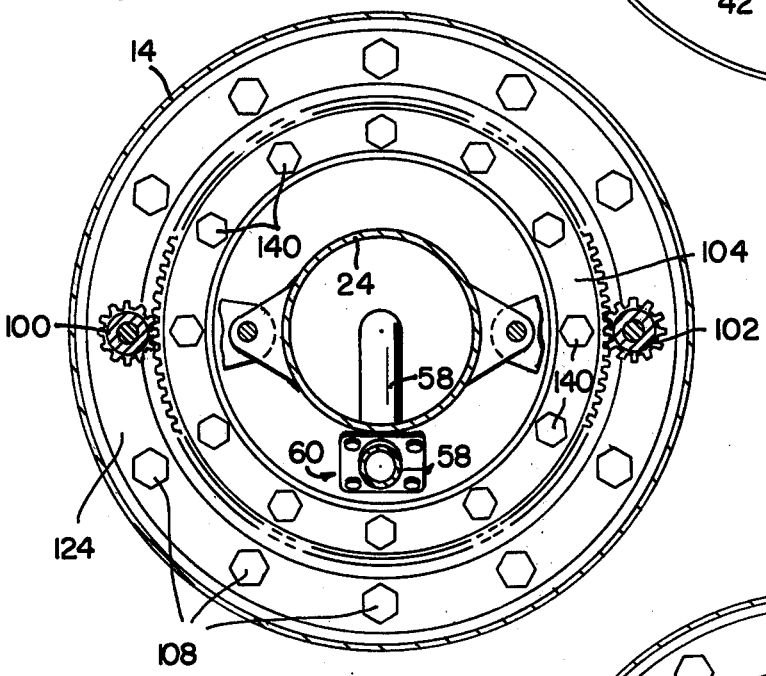
FIG. 6
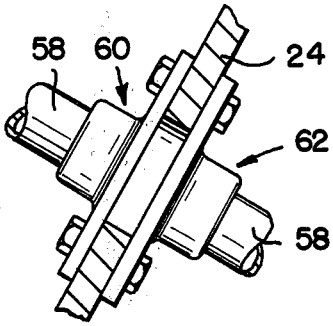
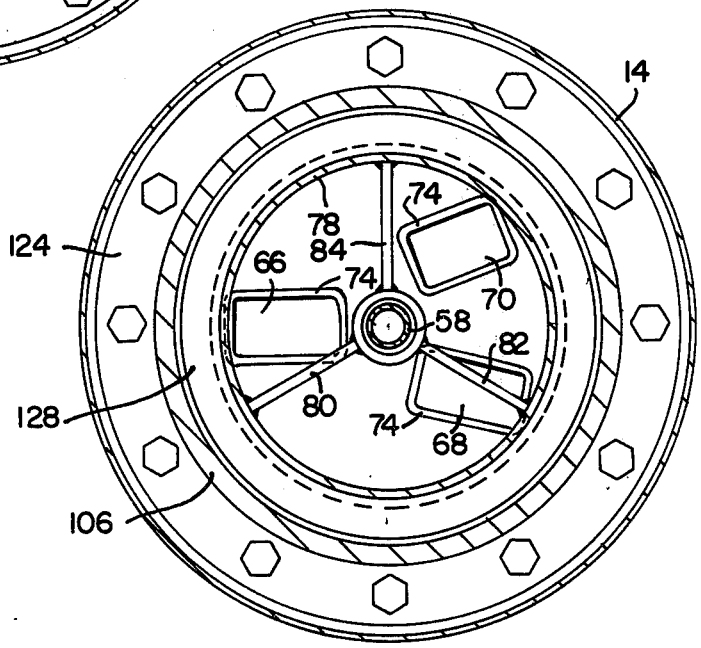
FIG. 7

IMPACT TUNNELING MACHINE WITH CUTTERS SPACED FOR EQUAL WORK

FIELD OF THE INVENTION

This invention relates generally to tunneling machines and more particularly to such machines for tunneling into rock, so as to form a relatively smooth walled bore of substantially any length and which may be remotely controlled from the tunnel mouth.

BACKGROUND OF THE INVENTION

Tunneling machines having impact type hammer cutting tools mounted on a rotatable workhead are, generally speaking, known in the art and it has been proposed, heretofore, to arrange the cutting tools about the workhead in a manner so that the entirety of the tunnel face will be worked on during each cycle of workhead rotation. It has also been proposed to arrange the cutting tools about the periphery of the workhead. These prior machines included suction means for exhausting or removing the cuttings from the tunnel face. However, a primary difficulty with these prior machines lies in the disposition of the tools about the workhead which, in turn, greatly affect the wear characteristics of the tools. That is, in the arrangement wherein the cutting tools are disposed about the periphery of the workhead, while allowing quick removal of the cuttings, a major drawback is arrangement of cutting tools about the working surface, which results in an uneven wearing of the cutting tools. As may be appreciated, with an arrangement such as this, the cutting tools will wear considerably quicker about their outer most edges as compared to the wear distributed to the inside edges. The uneven wear characteristics inherent with these machines results in time spent to replace worn tools and therefore valuable operating time is spent on maintenance of the machine.

SUMMARY OF THE INVENTION

In view of the above, and in accordance with the present invention, there is provided a tunneling machine having a rotatable workhead assemblage on which is mounted a plurality of rock cutting tools, including actuating guns, which are mounted in radially spaced series about the workhead in a manner so that the cutting paths of the tools will overlap radially from the center of the workhead and extend out upwardly to the periphery thereof. The problems of overcoming the uneven wear characteristic heretofore known is essentially overcome by disposing the cutting tools and actuating guns in such order and numbers about the workhead such that the average work done by each head per operating cycle is approximately equal whereby even distribution of wear upon the tools is attained. In accordance with a second feature of the present invention a shield just rearward of the tool's working surface and plurality of suction members which are in communicable association through the shield are provided. At the other end of the mechanism the suction members are in communicable association with a suction tube which also serves as a supportive structure for the machine. The shield prevents dust or loose rocks from faulting the operating mechanisms of the machine.

BRIEF DESCRIPTION OF THE DRAWINGS

Further aspects and advantages of this invention will become apparent from the description now to follow of the preferred embodiment thereof shown by way of example in the accompanying drawings in which:

FIG. 1 is a front elevational view of the machine, partially in section, and showing the operational components of the machine and illustrative of the nature of the invention.

FIG. 2 is an enlarged sectional view of a portion of FIG. 1 further showing the details of the connection between the rotatable portion and the stationary portion of the machine.

FIG. 3 is an enlarged sectional view of a portion of FIG. 2 showing a suitable connection between the fluid supply conduit and the fluid chamber.

FIG. 4 is a cross sectional view taken along line 4—4 of FIG. 1 and showing a unique sheave arrangement employed for moving the machine.

FIG. 5 is a cross section view taken along 5—5 of FIG. 1.

FIG. 6 is an enlarged sectional view showing a fluid supply conduit passing through a stem member on the machine.

FIG. 7 is a cross sectional view taken along line 7—7 of FIG. 1 and showing a plurality of equiangularly disposed blades secured to the forward portion of the stem means.

DETAILED DESCRIPTION OF THE PREFERRED EMBODIMENT

Figure 8:
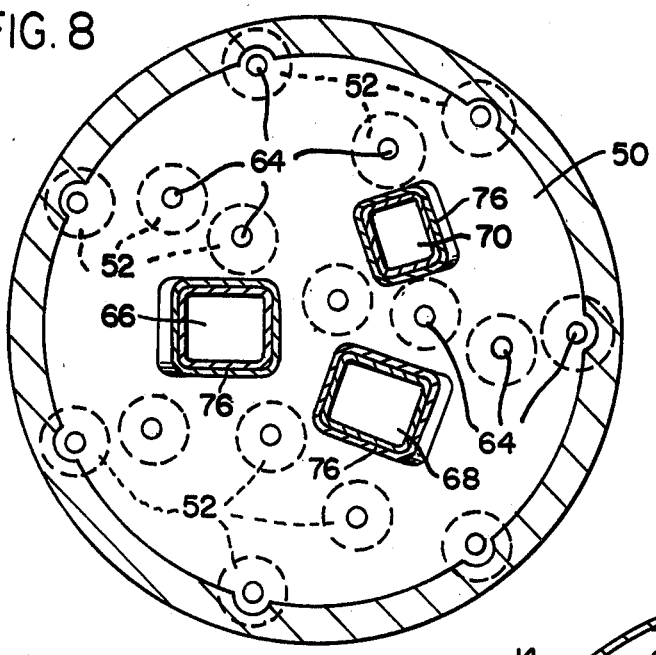
FIG. 8 is a view taken along line 8—8 and showing a cross section of the plenum.

Referring now in more detail to the drawings wherein like reference numerals indicate like parts throughout the several views, and more particularly to FIG. 1 where it is shown a tunneling machine 10 which includes a workhead assembly 12 adapted to be held fast to the forward an elongated shroud or inlet end 13 of 14. The workhead assembly 12 illustrated in the drawing includes a thick platelike circular member or shield 16 which acts as a closure at the forward end of the shroud 14. At the rearward or distal end 20 the shroud 14 is provided with a hood 22 which extends radially inward and closes about supportive hollow cylindrical stem 24 thereby forming an enclosed chamber about the entire operating mechanism of the machine. With this construction, any loose or surrounding material is prevented from falling or leaking into the operating parts of the machine.

As best seen in FIGS. 1, 2, and 4, the forward end 26 of the stem 20 is formed as an enlarged cone shaped 28. The rearward end 30 of the stem 20 is held fast by an apertured vent tube 32 which, in operation acts as an extension of the stem 24. A plurality of apertures 34 formed in the vent tube 32 allow escapement of gaseous dusts which may be present in the stem and tube 24 and 32 respectively, during operation of the machine.

Secured to the vent tube 32, in a manner so as to allow self alignment of the tunneling machine 10, are a plurality of sheave assembly 36, 38 and 40 (FIGS. 1 and 4). The sheave assemblies are comprised of pulleys means 40 which are rotatably mounted between the arm means 42 and 44 of a clevis 46 which, in turn, is attached to the vent tube 32. Entrained about the pulley means 40 is a cable 48, one end of which is connected to a suitable motor (not shown). Selective extension and retraction of the cable 48 permits the workhead assembly 12 to be raised or lowered in a plane perpendicular to the longitudinal axis of the shroud 14 at the will of an operator who, in the preferred embodiment, may be positioned remote from the tunnel mouth.

Figure 9:
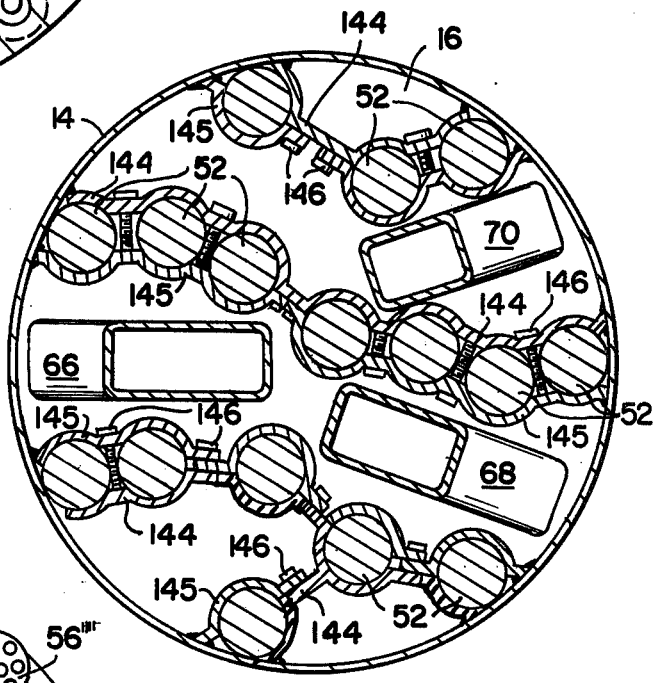
FIG. 9 is a cross sectional view taken along line 9—9 of FIG. 1 and showing how the impact hammers are radially spaced in series within the shield.
Figure 10:
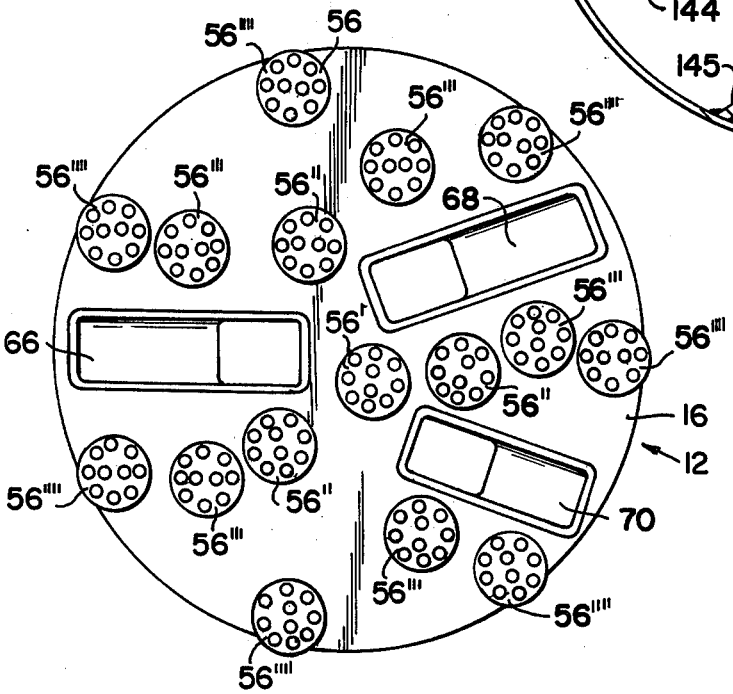
FIG. 10 is a bottom view of the machine taken along line 10—10 of FIG. 1.

Turning again to FIG. 1 it may be seen that a plenum or fluid chamber 50 is directly attached to the shroud 14 and, in a manner described hereinafter, is adapted for rotation therewith. Secured between the fluid chamber 50 and the thick platelike shield member 16 and totally encompassed by the shroud 14, are a plurality of equiangularly disposed impact hammers or guns 52. In the arrangement shown in the drawings, the impact hammers or guns are fluid-pressure operated and may be of the type sold by TRW Mission Manufacturing Company, a division of TRW, Inc. under Model No. A-5-3-15. The impact hammer 52 are commercially available items but it should be noted that a fluid under pressure is exhausted from the forward or proximate end 54 of the hammers during operation of the machine. As is apparent from FIGS. 1, 8, 9 and 10 each actuating guns 52 has removably secured to their forward end 54 an appropriate rock cutting tool which extend forwardly of the circular platelike shield member 16 along a common surface. The cutting tool means 56 are so arranged in number and in series so that upon rotation of the workhead assembly 12 each tool in the series travels a generally equal arcuate distance. As best seen in FIGS. 9 and 10, the cutting tools 56, as well as the actuating guns 52, are arranged in radially spaced series. The cutting tool means generally designated by the reference numeral 56 indicating the first series while those tools generally indicated as 56'' form the second series, the tools generally indicated in FIG. 10 by 56''' form the third series and those tools designated by 56'''' form the fourth series. As was mentioned above, to assure even wearing of the tools requires accurate placement of the tools in number and position about the workhead so that each tool does an equal amount of work. The average volume swept or crushed by each head or tool is proportional to the formula:

$$2\pi r/n$$

Where r is the radial distance each series is disposed from the center of the workhead and n is the number of tools in each series. In one particular example of the preferred embodiment, using a six inch diameter gun head, the centerline of the first series of tools 56' is disposed a 3 inch radial distance from the center of the machine 10. When computed the arcuate distance traveled by the tool 56' is generally equal to 18.849 inches. The second series of tools 56'' are disposed 9 inches from the centerline of the machine, but as may be seen in FIG. 10 there are three cutting tools in the series. When computed it may be seen that the arcuate distance traveled divided by the number of individual tool in the second series is generally equal to 18.849 inches. This careful numerical and radial placement is carried through the other series so that the disposition and number of tools in each series allows for an equal amount of work to be done by each of the tools during operation of the machine whereby resulting in even wear distribution on the tools.

It should also be appreciated that the outside diameter of the thick platelike shield member 16 and shroud 14 is less than the outside diametric path of the outermost series of cutting tool means 56''''. That is, as the cutting tools are rotated about the longitudinal axis of the machine 10 the circumferential path formed by the outermost series of cutting tools 56'''' is equal to 48 inches while the outside diameter of the shroud means 14 and platelike member means 16 is equal to 47.375 inches, in this example.

A fluid energy source, which may be, for example, steam but is preferably compressed air, is supplied to the plenum 50 via conduit means 58. As may be noted from FIG. 3, a rotary or swivel joint means, indicated generally by reference numeral 57 connects the stationary conduit means 58 with the rotating fluid chamber means 50. FIGS. 4 and 5 show that for a portion of its length, the conduit means 58 is offset from the longitudinal centerline of the machine and so as to allow a suitable connection between the conduit 58 and the fluid chamber 50, as was described above, there is provided direct connections 60 and 62 (FIG. 6) which provide for uninterrupted passage of the fluid energy through the stem 20.

As indicated in FIGS. 1 and 8, the fluid chamber 50 is provided with a plurality or series of apertures or connections means 64 which allow the actuating guns to become energized, there being one connection means 66 for each gun means 52. In this manner, as long as fluid energy is supplied to the plenum 50, and since the fluid chamber is rotated or oscillated along with the hammers 52, the connection 66 will supply the hammer means 52 with power regardless of the rotational position of the workhead 12. The continued flow of fluid under pressure to the hammers will be controlled by a suitable valve or control means (not shown) which is disposed in the conduit 58 for regulating the volume and pressure of the fluid energy supplied to the fluid chamber 50.

A further unique feature of the present invention is the provision of a plurality of suction means 66, 68, and 70 which, as shown in FIGS. 7 through 11, may be in the form of tubular members which in the preferred embodiment are square in cross section. In the arrangement shown in the drawings, the forward or nozzle end 72 of the suction means 66, 68, and 70 is mounted proximate the cutting tool 56 and thence the suction means taper rearwardly and at their distal end 74 are in communicable association with the stem 20. It should be noted that the portion of the suction means which passes through the plenum 50 is protectd from the pressures thereof by a reinforcing sleeve 76 (FIGS. 1 and 8) which completely encompasses or surrounds that portion of the suction means which passes through the plenum 50. As may be seen in FIGS. 1, 2 and 7, the distal end 74 of the suction means 66, 68, and 70 is encompassed by an annular ringlike member 78 which is secured to a forward or open end 26 of stem means 24. A plurality of equiangularly spaced blades 80, 82 and 84 are secured to the annular ringlike member means at a position intermediate the suction means 66, 68 and 70 and the forward end 26 of the stem 24 for purposes described hereinafter.

As mentioned above, the stem 24 is extended rearwardly by a vent tube 32. The distal end of the vent tube 32 is provided with radial flange 86 onto which a flange hose coupling 88 is secured. A flexible hose conduit 90 is attached to the coupling 88 and by means of suction producing apparatus (not shown) connected with the hose 90 a continuous suction or partial vacuum is created within the interior of the vent tube 32, the stem 24, and each of the suction means 66, 68 and 70 for purposes hereinafter to be described.

The workhead assembly 12 including the shroud 14 and the fluid chamber 50 are all rotated by a pair of pneumatic motors 92 and 94. However, it should be appreciated that by the construction of the present invention, that is by the shroud 16 being disposed the length of the machine 10 whereby forming an enclosed chamber about the operating mechanisms of the machine, it is well within the scope of this invention to actuate the motor 92 and 94 electrically rather than pneumatically. However, pneumatic motors are preferred so that the compressed air source can be used for all machine functions and to avoid any problems of short circuiting by water and to lessen the problems presented by explosive gases. Since the shroud 14 forms an enclosure about the operating mechanisms of the machine no debris can enter or when operating in a wet environment leak into the operating mechanisms protected by the shroud 14. Therefore the usual dangers inherent with electrical mechanisms when used in a wet environment are all alleviated.

As best seen in FIGS. 1, 2 and 5 the motors 92 and 94, through force transfer means 96 and 98, are in an operative driving relationship with spur gears 100 and 102 are mounted in a direct driving relationship with an annular ring gear 104 which is secured to and carried by an annular member 106. Through any suitable connection, such as bolts 108, the annular member 106 is attached to the fluid chamber 50. The motors 92 and 94 are carried on mountings 110 and 112 which, in turn, are attached to the outer surface of the stem 24. The motors 92 and 94 are angularly disposed relative the longitudinal axis of the machine so as to allow the largest possible motor size to be employed. Flexible connection means or Universal Joints 114 and 116 are mounted between the motors and the force transfer means whereby compensating for the angular displacement of the motors. As indicated in FIG. 1, the motors 92 and 94 are directly connected, via conduit means 118 and 120 with conduit means 58. Once the fluid energy is prevented from passing through the fluid chamber means 50 by the above mentioned valve means (not shown) fluid energy is also prevented from actuating the motors 92 and 94.

As shown in FIGS. 1 and 2, the workhead assembly 12 is secured against axial or longitudinal movement but yet is allowed rotational movement relative the stem 20 by means of a gland arrangement means 122 which rotatably mounts the fluid chamber means 50 relative the stationary stem means 20. The above mentioned annular member 106 forms a part of the gland assembly means 122 and is secured at its lower end 124 to the fluid chamber as discussed above. As shown, bearing ring means 126 and 128 encircle and project radially from the annular ringlike member 78, and are welded thereto to provide the means for connecting the rotary and stationary portions of the machine 10. As shown, this connection is made by means of an L-shaped ring 130 which is welded to the annular member 106 whereby rotating therewith. The ring 130 has a lower portion 132 which provides a horizontal running fit with ring 128 and an upstanding portion 134 adapted to provide a running vertical fit against rings 126 and 128. The annular ring gear 104 is disposed on the upper surface or second end means 136 of the annular member 106 and is adapted to project radially beyond the upstanding periphery of the member 106. Secured to the upper end means 136 of member means 106 is a flat bearing ring 138 which provides a bearing for axial thrust between the rotary and stationary parts of the machine. The three elements 104, 106, and 138 are rigidly secured together by a plurality of equiangularly spaced bolts 140. To provide for further bearing against axial thrust between the stationary and the rotating parts of the machine, a second flat bearing ring 142 is disposed between ring 130 and the upper surface of the fluid chamber 50 and is welded to the latter. As may be appreciated, the gland arrangement assembly 122 is also protected from any falling or flying debris by the shroud 14 extending generally the length of the machine and forming an enclosed chamber thereabout.

Also spanning the distance between the fluid chamber 50 and the platelike shield member 16 are a plurality of structural members 144 are shaped to conform in part to the outer surface of the guns 52 and 50 arranged as to contact each gun 52, and are situated about the workhead assembly and add structural strength to the machine and more particularly add to the connection between the fluid chamber 50 and the thick plate-like shield member 16. At this point, it will be understood that when the fluid chamber 50 is rotated through suitable connections by the motors 92 and 94, the workhead assembly 12 also is rotated. By rotatably mounting the fluid chamber 50, the plate 16 and the actuating guns 52 in tandem it may be seen that as long as fluid energy is supplied to the plenum 50, the gun means 52 will likewise be supplied, regardless of the angular position of the rotary portion of the machine. As mentioned above, the flow of fluid energy to the fluid chamber 50 and each of the motor means 92 and 94 and hence general operation of the machine, will be controlled by the above mentioned valve means which is disposed in a position above the point whereat the conduit means 118 and 120 are connected to the conduit means 58.

Turning again to FIG. 10, which shows the cutting surface of the workhead assembly 12, it may be seen that in view of the equiangularly displacement of the cutting tools 52 in the radially spaced series 56', 56'', 56''', and 56'''' that the arcuate paths of the cutting tools created when the workhead assembly 12 is rotated will overlap radially from a point closely adjacent the longitudinal assembly centerline of the machine 10 and extend beyond the greatest radial dimension of the workhead assembly 12 or shroud 14. The unique disposition of the cutting tool means 52 in number and so arranged about the workhead means 12 so that each tool will move a generally equal amount during rotation of the workhead assembly 12 will not only result in that the entire surface area of the tunnel face will be worked on simultaneously, but also this unique arrangement of the tools results in an equal distribution of wear being placed on the tools during each cyclic rotation of the workhead.

OPERATION OF THE MACHINE

In operation of the tunneling machine the fluid energy required for operation of the machine may be supplied from a suitable source (not shown) to the conduit 58. By way of suitable connections 118 and 120 branching from the conduit 58 fluid energy is delivered to the motors 92 and 94 whereby rotating the workhead assembly 12 including the shroud 14 and the fluid chamber 50. At the same time as the motors are activated energy is delivered to the fluid chamber 50 and by way of connection 66 the gun means 52 are actuated. While power is being delivered to the various mechanisms of the machine 10, a suction of partial vacuum is applied to the stem 24 and in view of the communicable association with the stem 24 a suction or partial vacuum is created within the interior of the tubular members 66, 68, and 70. The machine, and more particularly the cutting tool 52 are lowered toward a working relationship with the tunnel face and upon contact therewith the operation of the impact hammers will cause the tools to impact cutting action on the tunnel face whereby crushing and pulverizing the rock material operated thereupon. However, the thick platelike shield member 16 which forms a closure at the inlet end of the shroud means 14 prevents any gaseous dusts or pulverized material from interfering with the operating mechanisms of the machine. The cuttings formed by the tools are immediately picked up by the suction created within the interior of the suction means 66, 68 and 70 and are carried from the tunnel face via a substantially closed suction system comprised of the suction members 66, 68, and 70, the stem 24 and the apertured vent tube 32.

As mentioned above, mounted intermediate the discharge end of the suction members and the cone shaped forward portion 28 of the stem 24 are a plurality of blade means 80, 82 and 84. The blade means serve to further pulverize the rocks which are being rearwardly conveyed by the closed suction system to the tunnel mouth whereby enhancing the handling characteristics of the debris once it reaches the exhaust end of the flexible hose means 90. Pulverization of the debris by the blades also aids in preventing clogging of the closed suction system as the debris is carried rearwardly. The air or other fluid exhausted from the forward end of the gun means 52 also aids in forcing the cuttings within the suction area of the tubular members 66, 68 and 70.

As the cutting tool means 56 operate against the tunnel face, the workhead assembly 12 is being rotated or oscillated about its longitudinal axis by the motors 92 and 94. In view of the placement of the cutting tools in radially spaced series, the entirety of the tunnel face will be operated upon during each cycle of the workhead rotation. Thus, an operator who may be remote from the tunnel mouth can control the operation of the machine so that the workhead assembly means can continuously and at a substantially uniform rate cut its way into the rock into which the tunnel is to be made.

Although all of the above has added to the improved operating characteristics of the machine, it should be appreciated that one of the main advantages of the present invention is the disposition of the cutting tools in such manner and order about the workhead so that even distribution of wear is placed on each individual tool. The disposition of the cutting tools about the workhead assembly 12 being such that upon rotation of the latter the arcuate distance traveled by each series of tools divided by the number of tools in the series is approximately equal and thus, the work performed by each tool upon the tunnel face will be equal. Therefore, since the tools wear evenly, routine maintenance of the machine allows replacement, if necessary, of all of the cutting tools simultaneously rather than requiring frequent maintenance so as to replace a few wornout tools as been heretofore known in the art. A preferred example of the preferred embodiment was above described using six inch diameter individual gun workheads. Such a machine may be readily adapted to be made with two sets of guns for a two foot diameter drilling machine, or three sets for a three foot diameter machine, as well as with four sets, as depicted for a four foot diameter drilling machine.

Thus it is apparent that there has been provided, in accordance with the invention, a Tunneling Machine or the like that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A workhead assembly for a tunneling machine comprising:

a shroud means;

a rotatably mounted circular plate adapted to form a closure at the inlet end of said shroud means;

a plurality of cutting tool means arranged in radially spaced series about said plate and projecting forwardly therefrom, said tools being of such number and so arranged in series that the distance traveled by each tool upon rotation of said circular plate divided by the number of tools in that series is generally equal; and means mounted for rotation with said circular plate means for removing cuttings from the area of the tunnel face as they are formed.

2. A workhead assembly means according to claim 1 wherein each working cycle is a full rotation and upon rotation of said circular plate the centers of said cutting tool means define a plurality of spaced concentric circles.

3. A workhead assembly means according to claim 2, wherein the spacing between said concentric circles is approximately equal to the average outside diameter of said cutting tool means in the adjacent circles.

4. A workhead assembly means according to claim 1 wherein upon rotation of said circular plate means the periphery of said cutting tool means define generally adjacent concentric ring paths which extend from a point closely adjacent the longitudinal axis of said shroud means to beyond the periphery of said shroud means.

5. A tunneling machine comprising:

a plurality of cutting tool means;

a rotatably mounted workhead assembly means adapted to mount said cutting tool means in radially spaced series, said tools being mounted in such number and series so that the arcuate distance traveled by each tool upon rotation of said workhead assembly means divided by the number of tools in that series is generally equal;

means for turning said workhead assembly means;

rotatably mounted shroud adapted to concentrically surround said workhead assembly substantially the length of the machine, said shroud being closed rearwardly of said means for turning whereby forming an enclosed tubular chamber means; and a plurality of suction means passing through said shield for removing cuttins from the tunnel face as they are formed by said cutting tool means.

6. A tunneling machine comprising an enclosed tubular shroud means;

a plurality of cutting tool means;

workhead assembly means adapted to mount said cutting tool means in radially spaced series, said tool means being mounted in such number and so disposed that each tool in said series performs substantially equal work on the tunnel face;

a hollow cylindrical stem means;

means for rotatably supporting said workhead assembly on said stem means;

means providing a plenum mounted intermediate the ends of said shroud means and adapted as a common actuation means for each of said tool means;

means for supplying fluid energy to said plenum for actuating said tool means; and suction means for removing cuttings form the tunnel face as they are formed by said tool means.

7. A tunneling machine according to claim 6 and further including impact hammer means mounted intermediate said workhead assembly means and said plenum means for delivering power from the latter to said cutting tool means.

8. A tunneling machine according to claim 6 and further including a plurality of blade means equiangularly disposed between said workhead assembly means and said stem means for effecting said cuttings.

* * * * *